US005722333A

United States Patent [19]

Hyun

[11] Patent Number: 5,722,333

[45] Date of Patent: Mar. 3, 1998

[54] INCINERATOR FURNACE WITH FIRE GRATE AND AIR SUPPLY

[76] Inventor: Kwangsoo Hyun, 8-30 Sungsoo-2-Ga-2-Dong, Sungdong-Gu, Seoul, Rep. of Korea

[21] Appl. No.: 418,633

[22] Filed: Apr. 10, 1995

Related U.S. Application Data

[63] Continuation-in-part of Ser. No. 128,071, Sep. 28, 1993, abandoned.

[30] Foreign Application Priority Data

Sep. 30, 1992 [KR] Rep. of Korea ..... 92-17830

[51] Int. Cl.[6] ..... F23G 5/00; F23G 7/00

[52] U.S. Cl. ..... 110/247; 110/248; 110/275; 110/288; 110/165 R; 126/182; 126/163 R

[58] Field of Search ..... 110/247, 248, 110/258, 259, 275, 278, 288, 165 R, 298, 300; 126/163 R, 182, 152 R, 152 B, 170

[56] References Cited

U.S. PATENT DOCUMENTS 801,251 10/1905 Kilbourne ..... 110/248

4,014,664 3/1977 Kupfer et al. .

*Primary Examiner*—Henry A. Bennett

*Assistant Examiner*—Susanne C. Tinker

[57] ABSTRACT

This invention provides a variety of incineration furnace with modular fire grate apparatus for cylindrical incinerator furnaces of water jacket configuration. The invented fire grate module is provided with refuse dump agitation capability from underside of waste fuel dump on the fire grate and also with air supply function in the fire grate apparatus itself. The fire grate module basically comprises radially laid out and circumferentially arranged air supply pipings at an angular interval, an upstream coolant water jacket and a downstream coolant water jacket of the fire grate module being connected through two water channels of the air supply pipings, a central junction body to secure said air supply pipings, an air plenum encircling the coolant water jackets for admission of pressurized air into the air pipings of the air supply pipings, a moving grate supported and rotationally driven by at least two idler shafts and one or more drive shaft, a stationary grate mounted on top of the air supply pipings, and a reducer-attached drive motor connected to the drive shaft so that when driven by the motor the moving grate will perform a fluctuational agitation of the merry-go-round motion, thus providing agitational effect, more thorough air admission into the uderside and inside of dumped refuses in the incineration chamber, improved incineration capacity and the combustion efficiency as well as the significant suppression of generation of toxic gases.

45 Claims, 13 Drawing Sheets

INCINERATOR FURNACE WITH FIRE GRATE AND AIR SUPPLY

CROSS-REFERENCES

The present application is a continuation-in-part application of my application Ser. No. 08/128,071 filed Sep. 28, 1993, entitled "Merry-Go-Round Agitation Fire Grate Module for Household and Industrial Waste Incinerator Furnaces," now abandoned. The present application is related to my application Ser. No. 08/373,959 filed Jan. 17, 1995, entitled "Fire Grate Having Fluctuational Profile In Circumferential Direction Thereof," now abandoned and to my another application Ser. No. 08/379,687 filed Jan. 26, 1995, entitled "Water-Cooled Air Supply Piping," now abandoned; Both of which are divisional applications of the parent application Ser. No. 08/128,071. This application is also related to application Ser. No. 08/162,465 filed Dec. 7, 1993, entitled "Apparatus for Complete Combustion by Use of Multi-Stage Multi-cycle Composite Air Water Pipings Inducing Complex Incineration/Combustion Node of Suction, Whirling Flow, Inversion, and Airborne Capturing," currently abandoned.

BACKGROUND

The present invention relates to a fire grate module having air supply function and optionally agent burning as well as agitational mechanism which can be installed underneath the cylindrical incineration chamber body of small and medium capacity incinerator furnaces of water jacket configuration.

Up to the present time, the fire grate used in the water jacket type small and medium size cylindrical refuse incinerator furnaces has been of basically plain circular plate type or square rectangular type one with circular holes or square lattice cavities thereon respectively to provide discharge passage to ash siftings of the dumped burning refuse in the upper incineration chamber and also to provide air passage therethrough from underneath to supply burning agent inclusive of air to the refuse dumps on the fire grate. The supply of air into the incineration chamber is not sufficient enough with this air supply design configuration even though there are air jet nozzles on the inner shell of the incineration chamber. Even with air supply devices in the square fire grate such as Korean pat. No. 18888, for example, air openings are prone to being plugged up as with coagulated plastic melt due to the vertical orientation of air jet openings. Further, that patent shows inconsistent ash shifting gap area with respect to time while agitator comb pulsates cyclically so that relatively big loaf of incompletely burnt combustibles can be discharged downward through the gap when the agitator comb is at its top and bottom dead centers.

On the other hand, there has been no central and/or radially arranged support devices for the fire grate of water-cooled cylindrical incinerator furnaces that is provided with reliable structural rigidity of the fire grate exposed to extreme heat of the incinerator furnace. Further negative aspects of the conventional circular-planform fire grate design comprise lack of air supply devices in the fire grate apparatus itself, lack of agitation function in the fire grate for preservation of agitational features for incineration of high water content gel type combustibles such as sludges as a means of providing more thorough air supply, and deterioration of structural integrity under elevated temperature condition as the diameter of the grate is increased. In this regard, provision of structural rigidity to the fire grate has been restricted to passive increase of the structural stiffness of the circular-planform fire grate in an endeavor to have greater incineration capacity as by increasing the diameter of the grate.

Due to the lack of rigorous agitation mechanism in the conventional fire grates, toxic gases as well as smokes are allowed to be generated resulting from inadequate supply of air during the process of incineration of waste materials stacked on the fire grate and insufficient refuse-air contact area compared with that of the present merry-go-round (hereinafter, "MGR") agitation fire grate with air supply.

Due to the above mentioned negative design features of the current fire grate configuration, scaling up of the diameter of the incineration chamber of the incinerator furnaces to take care of massive incineration of municipal and industrial refuses has been hindered such that the dimension of cylindrical incinerator furnaces of water jacket configuration is restricted to small size of the incineration chamber, say, 1 meter at best, which is mainly due to the deterioration of the structural rigidity at high furnace operating temperature. Additionally, accessability into the air piping or duct of the air supply devices of the conventional design has not been provided so that once accumulation of foreign stuffs blocking the air passage is made, then taking out of those unwelcome stuffs fed up in the air piping or duct is extremely hard to carry out and sometimes impossible for some design configurations. Under these circumstances, the advent of a fire grate provided with air supply function in the fire grate itself and selectively with positive agitational mechanism has been anticipated.

SUMMARY

The present invention is intended to overcome the above described disadvantages of the conventional fire grate of the cylindrical type small and medium size incinerator furnaces of water jacket configuration.

One version of the present invention is a modular fire grate apparatus with air supply and agitational mechanism, the apparatus comprising at least three air supply pipings, the cross section of which having two air passages and two water channels partly surrounding the two air pipings to prevent the air pipings from being heated up, an annular coolant water jacket divided into an upstream and downstream coolant water jackets by the air supply pipings and fan-shaped baffle plates, the upstream and downstream coolant water jackets being connected to each other through the two water channels of the air supply pipings, a first junction body being placed at the center of the apparatus and welded to each negative radial end of the air supply pipings circumferentially arranged in radial layout, an air plenum encircling the outer shell of the annular water jacket and for supplying pressurized air into the air piping of the air supply pipings, a moving grate having concentric fluctuational fin-shaped rib rings and an outermost ring provided with a fluctuational geared track thereon, idler shaft assemblies for supporting the moving grate, a drive shaft assembly for supporting the moving grate together with idler shaft assemblies and also for inducing a MGR agitational motion while maintaining the axis of the rotation of the moving grate when a drive shaft of the drive shaft assembly having a drive gear thereon is rotationally driven, rotational drive means secured to the drive shaft, and a stationary grate for supporting waste materials thereon, the stationary grate having concentric rings having fluctuational profile in the circumferential direction thereof, the stationary grate being mounted on the air supply pipings from above, whereby pressurized air is admitted underside and inside of the dumped refuse when the fin-shaped rib rings of the moving grate protrudes above the upper surface contour of the stationary grate while performing MGR motion through the gap between the two radially neighboring concentric rings of the stationary grate so that speedy incineration is achieved due to the increase of specific refuse-air contact area and that waste materials having high viscosity and water content may effectively be incinerated.

Another version of the present invention is an integral fire grate apparatus devoid of agitational features of the first version of the invention, the apparatus comprising at least three air supply pipings, a coolant water jacket divided into an integral upstream water jacket and the downstream water jacket, a second junction body placed at the center of the apparatus and welded to each negative radial end of the air supply pipings circumferentially arranged in radial layout and also to the bottom of the apparatus, the air plenum, and the stationary grate, whereby pressurized air is admitted underside of the dumped refuse on the stationary fire grate so that additional void space for pressurized air admission is provided due to the fluctuational profile of the upper surface of the stationary grate.

One of the distinctive features of the invented modular fire grate apparatus is about the cooling of the hollow idler shafts exposed to transverse load applied thereon on top of elevated furnace operating temperature. One version of the idler shaft cooling system comprises a cooling impeller for cooling of idler shafts supporting the moving grate, and cooling of the heated coolant lubricant in cooler tubings connecting each shaft housing by placing them in the cold water of the upstream coolant water jacket. Another version of the idler shaft cooling system is made by separating the cooling impeller plugged in the central axial cavity of the idler shaft into two pieces, an impeller for making radial flow of coolant lubricant with respect to the axis of rotation of the idler shaft in the hot chamber, and a trumpet-shaped divider plate which is essentially said cooling impeller devoid of blades thereon.

Another features of the invention comprises the provision of the control of pressurized air influx into and air piping cleaning opening on the air plenum, and the provision of agent-burning function to the water jacket type incinerator furnaces with burning-agent feed-in devices and cyclic feed-in method which can drive out burners in getting agent burning done for incinerator furnaces as for high water content sludges for which agent burning and agitation are required for successful incineration.

Accordingly, one purpose of this invention is to provide air supply function to the fire grate apparatus itself such that pressurized air is injected underneath the dumped refuse on the stationary grate of the fire grate module or integral apparatus.

Another purpose is to provide a MGR motion type agitation mechanism to the fire grate apparatus depending on the incinerator furnace design requirements so that ample amount of air is admitted into the incineration chamber and even inside the dumped refuse on the stationary grate of the fire grate module or apparatus.

Another objective is to have improved refuse fuel volume reduction ratio for the incinerator furnace with reduced clearance between the the spacing between the concentric rings of the stationary grate and the concentric rib rings of the moving grate of this invention.

BRIEF DESCRIPTION OF THE DRAWINGS

These and other objects, features and many of the attendant advantages of this invention will be appreciated more readily as the same become better understood from a reading of the following detailed description when considered in connection with the accompanying drawings, wherein like parts in each of the several figures are identified by the same reference character selectively with lower case alphabetical characters suffixed thereto, and wherein.

DESCRIPTION OF THE PREFERRED EMBODIMENTS

Figure 1:
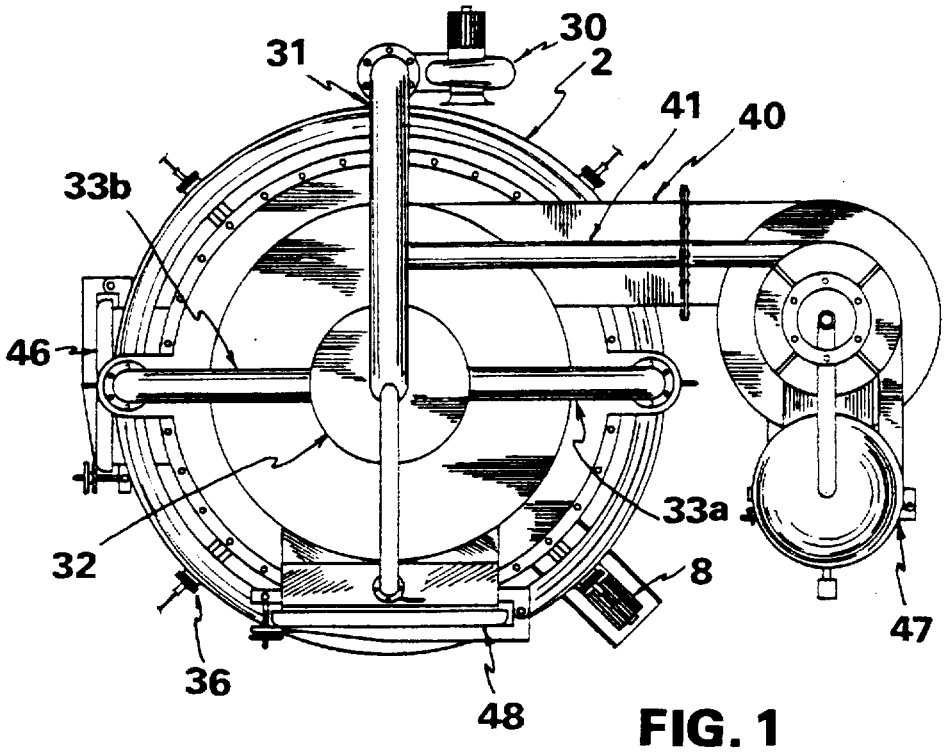
FIG. 1 is a top plan view of a modular incinerator furnace wherein a four-cycle mode embodiment of the MGR agitational motion fire grate module of the present invention is installed.
Figure 2:
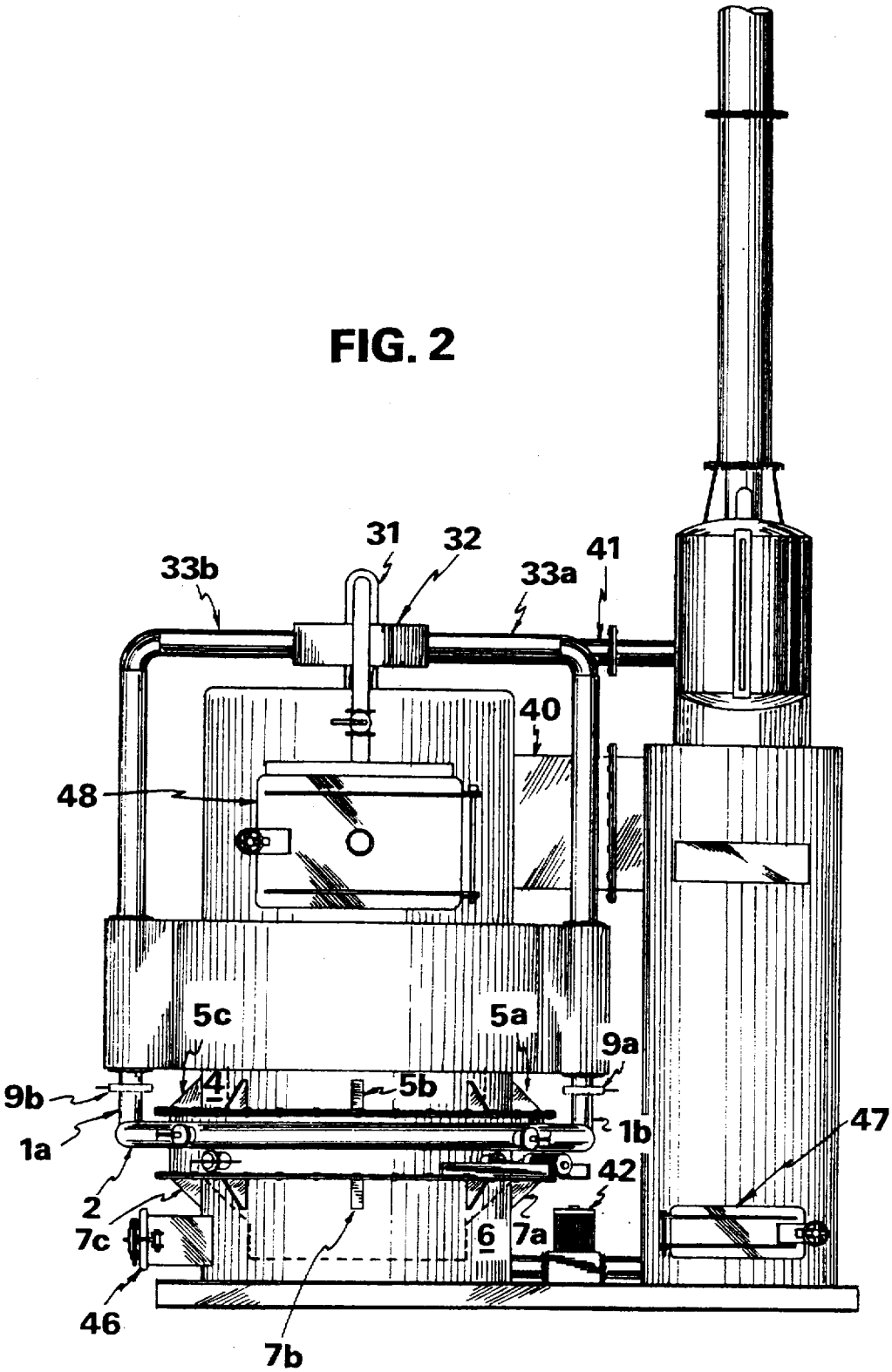
FIG. 2 is a front elevational view of FIG. 1.

Referring now to FIGS. 1 and 2 which is a top plan view and front elevational view of a modular incinerator furnace respectively which is constructed with a 4-cycle mode preferred embodiment of a modular fire grate apparatus with agitational mechanism performing MGR motion of the present invention and an embodiment of my application Ser. No. 08/162,465, filed Dec. 7, 1993, entitled "Apparatus for Complete Combustion by Use of Multi-Stage Multi-Cycle Composite Air Water Pipings Inducing Complex Incineration/Combustion Mode of Suction, Whirling Flow, Inversion, and Airborne Capturing," currently abandoned, pressurized air is generated by a fan blower 30, and supplied into an upper hoop air plenum, the front view thereof shown in FIG. 2, through a primary air supply piping 31, an upper air plenum 32, and two secondary air supply pipings 33*a*, 33*b*. Some portion of the pressurized air in the air distribution hoop chamber is fed into the upper incineration chamber and the rest of the pressurized air in the upper hoop air plenum is driven through air intake pipings 1*a*,1*b* into an air plenum 2 wherein supplied air is admitted into the bottom and inside of the waste dump in the incineration chamber through a plurality of air openings 18*a*,18*b* (shown in FIGS. 4, 9, and 12) on air pipings 14*a*,14*b* of each of a plurality of air supply pipings. Here, a couple of air flow rate control valves 9*a*,9*b* play as air flow rate control regulators. On the other hand, cylindrical shell column on the right hand side is a cyclone separator unit enclosed in a water jacket together with an ancillary hot water storage/circulation reservoir and a chimney.

Figure 3:
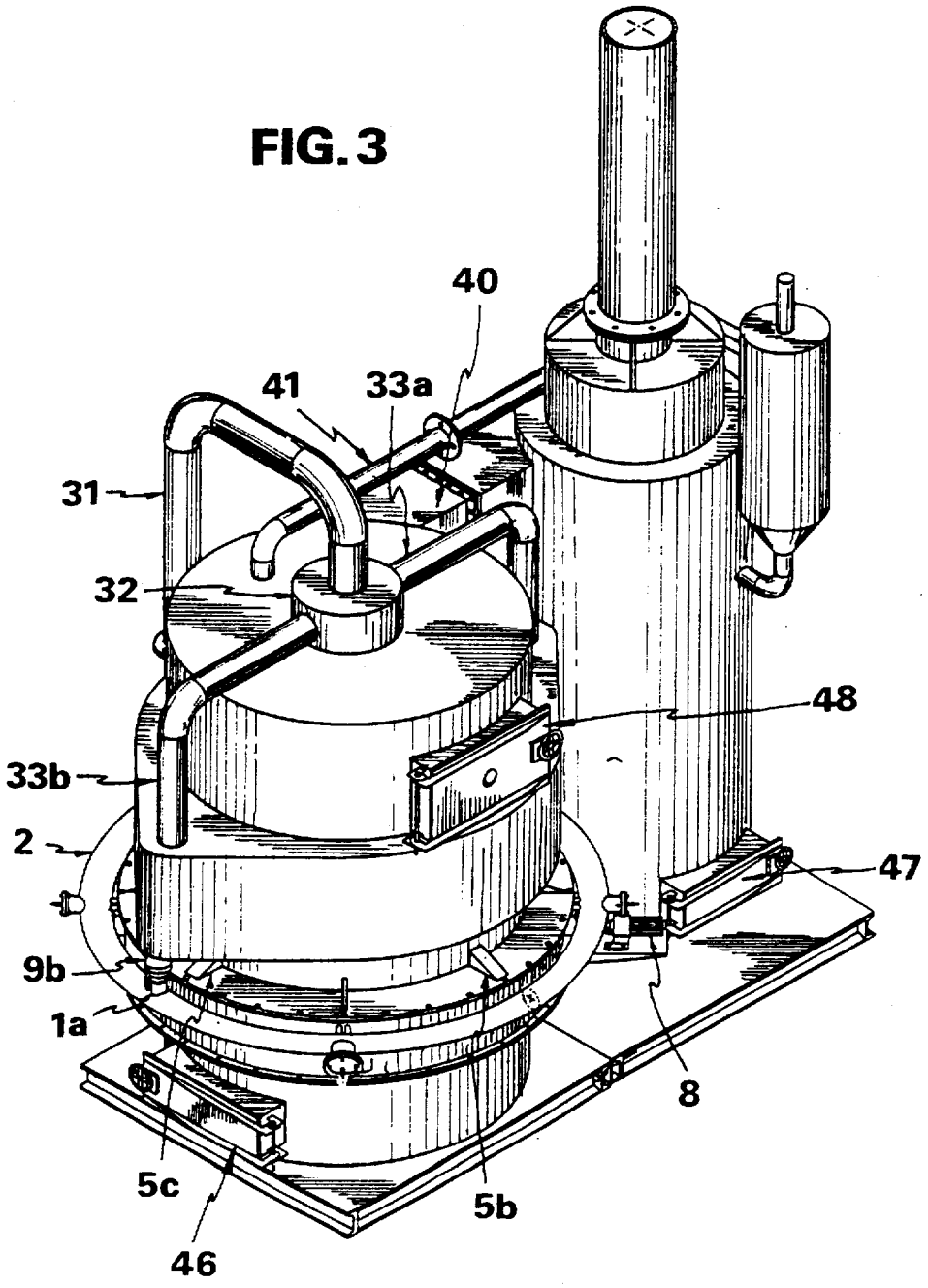
FIG. 3 is a bird's eye view of an incinerator wherein a four-cycle mode embodiment of the MGR agitational fire grate module of this invention is assembled.

Referring to FIG. 3 which is a bird's eye view of an incinerator furnace wherein a four-cycle mode embodiment of the MGR agitational fire grate module of this invention is assembled, refuse material feed-in is made through a refuse feed door 46 and the primary ash and secondary dust sifting is made through an ash discharge door 46 and a dust discharge door 47 respectively. The flue gas exhaustion out of the incineration chamber is made through an exhaust duct 40 and is driven into the cyclone separator nested in the right hand side shell column. As for the coolant water circulation, the upper incineration chamber is enclosed by inner and outer water jacket shells with coolant water in between them so that the heated water is driven into a water jacket between the cyclone separator and outer cyclone separator shell through a coolant water circulation piping 41 by the pumping pressure of a coolant water circulation pump 42 connecting the water jacket of the right hand side cyclone separator unit and lower water jacket 6 (shown in FIG. 2) of ash discharge lower body. With this water jacket configuration, all units of the incinerators are water cooled so that the outer shell surface temperature can be kept as low as possible. As an additional teaching, the incineration waste heat transferred to the coolant water can be utilized by placing an heat exchanger in the flow circuit of coolant water circulation.

Figure 4:
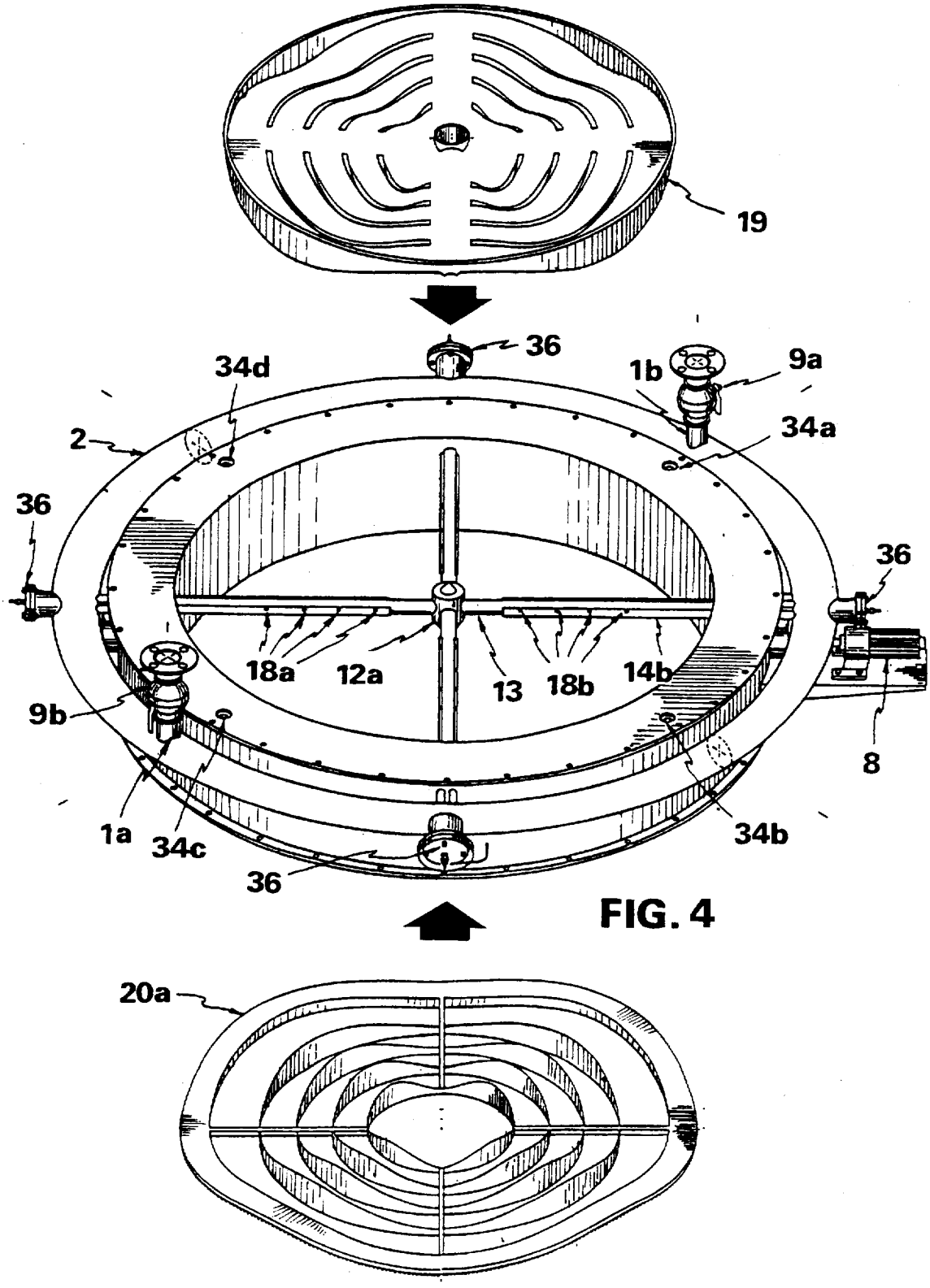
FIG. 4 shows perspective views of four-cycle mode preferred embodiments of a stationary grate, a skeletal MGR fire grate module, and a first moving grate according to the present invention.

Referring to FIG. 4, perspective views of a four-cycle mode preferred embodiment of a stationary grate 19, a skeletal MGR fire grate module, and a first moving grate 20*a* show how the first moving grate 20*a* and the stationary grate 19 are assembled to make entire MGR motion agitation fire grate module. The first moving grate 20*a* is assembled from underneath the module and is supported by three idler shafts 21*a*,21*b*,21*c* and a first drive shaft 22. The stationary grate 19 is, however, just mounted on the four air supply pipings. Securing of the stationary grate 19 in place is done by placing the tipper incineration chamber body such that the upper plain-circular rim of the stationary grate 19 is to be mated and fitted in place by the lower flange of the upper incineration chamber body.

Figure 5:
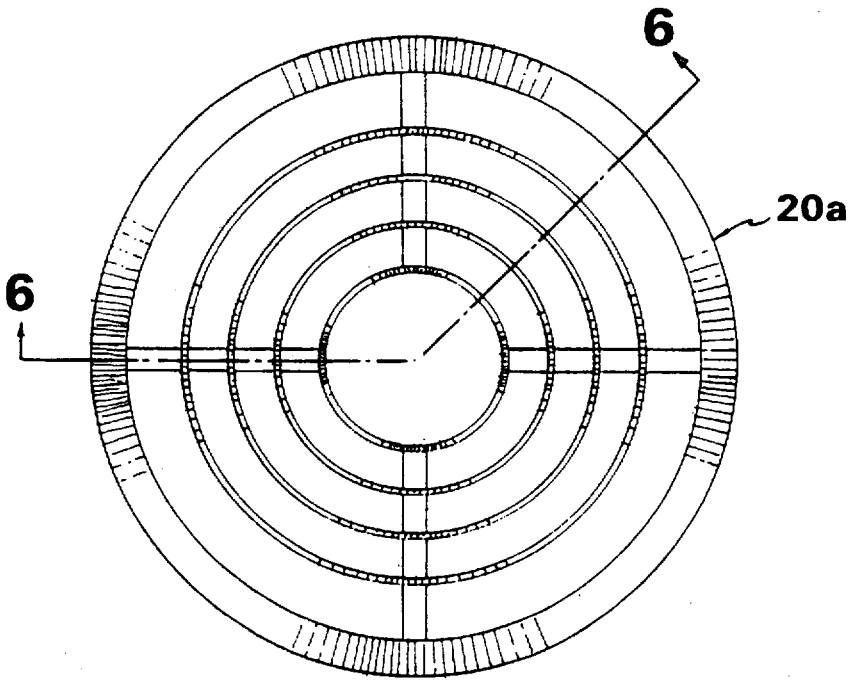
FIG. 5 is a planform view of the first moving grate.
Figure 6:
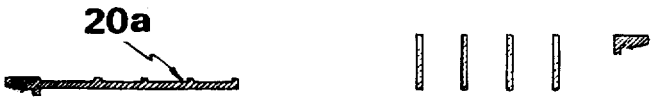
FIG. 6 is a longitudinal section of the first moving grate taken along the line 6—6 of FIG. 5.

FIG. 5 and FIG. 6 is a planform view and longitudinal section of the first moving grate 20*a* taken along the line 6—6 of FIG. 5 respectively. The first moving grate 20*a* is supported by the three idler shafts 21*a*,21*b*,21*c* clearly shown in the longitudinal- and cross-sectional view of the module in FIG. 12 and 13 respectively, each idler shaft being supported by two bearings 24 (shown in FIGS. 12 and 17) enclosed in each of three idler shaft housings 10*a*,10*b*,10*c*, and by the first drive shaft 22 also supported by the two bearings 24 enclosed in a drive shaft housing 11, basically same housing as each of the three idler shaft housings 10*a*,10*b*,10*c*. The first drive shaft 22 in the drive shaft housing 11 is driven either by a lever type handle or by a drive motor 8 (shown in FIGS. 1–4,7 and 8) mounted on a bracket welded to the outer shell of the MGR agitation fire grate module. On the other hand, the upper surface of the outermost ring of the first moving grate 20*a* is of a sinusoidal profile in circumferential direction thereof and the lower surface of the outermost ring of the first moving grate 20*a* is gear-teethed on a sinusoidal profile so that when driven by the first drive shaft 22 with a drive gear 23 thereon, then MGR motion is made about the axis of rotation of the first moving grate 20*a* preserved by the support of the three idler shafts 21*a*,21*b*,21*c* and the first drive shaft 22. Additional feature of this embodiment of geared track machined on the lower surface of the outermost ring of the first moving grate 20*a* provides prevention of accumulation of waste materials in between the gear and the geared track of the first moving grate 20*a*.

Figure 7:
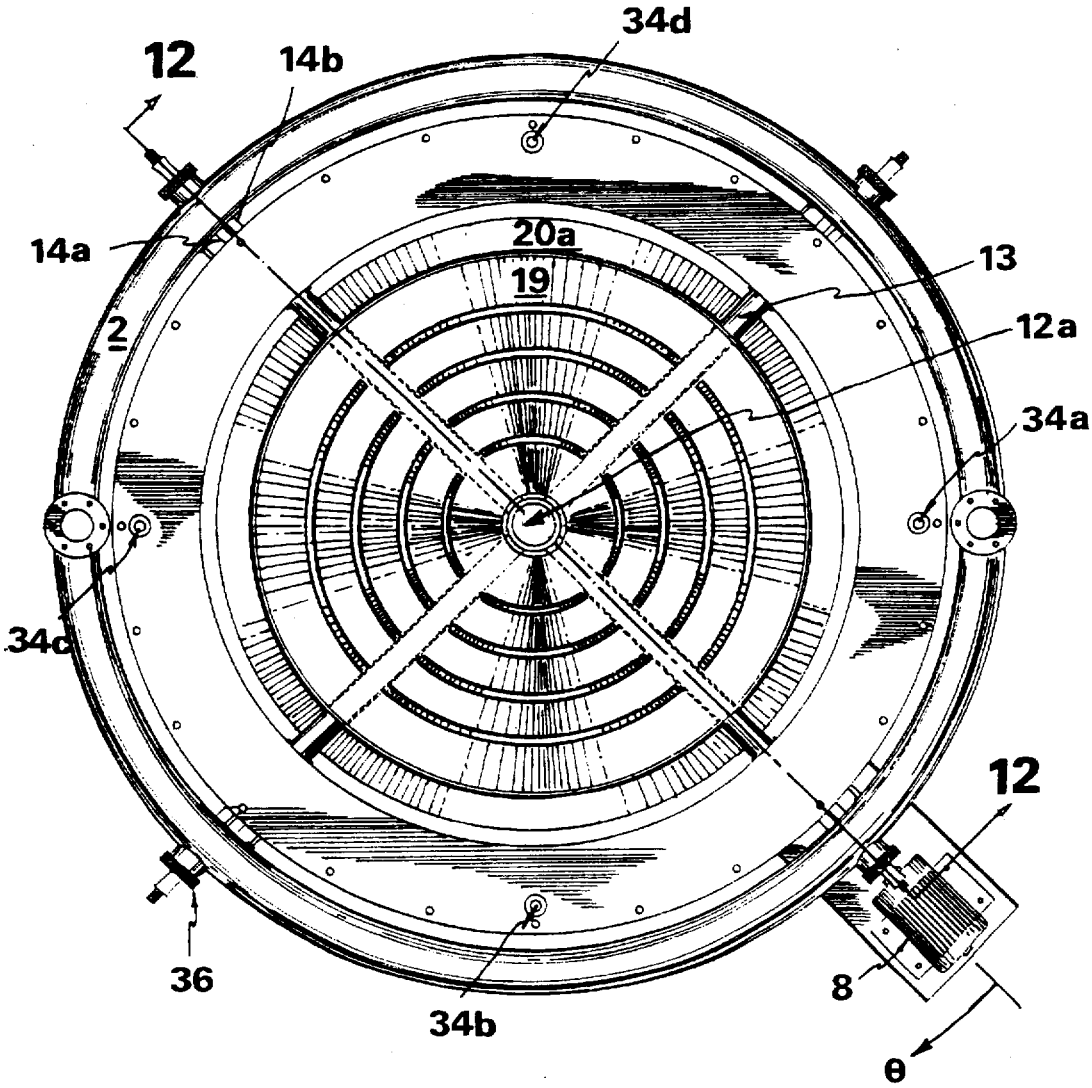
FIG. 7 is a top plan view of a four-cycle mode embodiment of the MGR agitation fire grate module pursuant to this invention.

Referring to FIG. 7, a top plan view of a four-cycle mode embodiment of the MGR agitation fire grate module in accordance with the invention is shown to reveal the planform views of the air plenum 2, upper ring-shaped flange having four exhaust coolant water outlet 34*a*,34*b*,34*c*,34*d*, and the stationary grate 19 in pair with the first moving grate 20*a*. As shown in this planform view, the inner diameter of the outermost ring of the first moving grate 20*a* is slightly greater than the outside diameter of the stationary grate 19, and downward ash sifting is made through the clearance made by pairing of each rib ring of the first moving grate 20*a* and the gap between the two radially neighboring concentric rings of the stationary grate 19.

Figure 8:
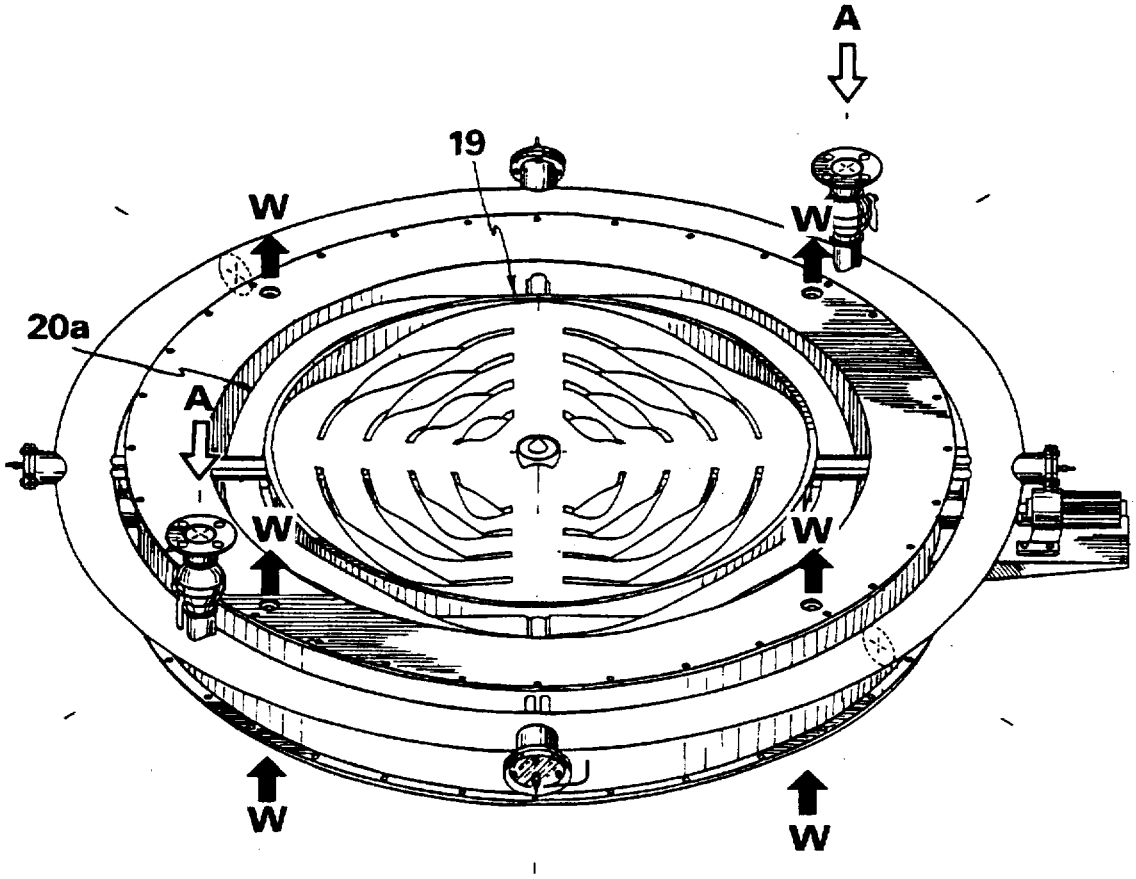
FIG. 8 is a perspective view of the four-cycle mode embodiment of the MGR motion fire grate module with the stationary and moving grates loaded on the module showing coolant water and pressurized air flows.

FIG. 8 is a perspective view of the entire MGR motion fire grate module with the stationary grate 19, the first moving grate 20*a*, and all of the other elements of this invention loaded on the module with the first moving grate 20*a* at its top dead center of its MGR agitational motion. The figure also shows combustion air and coolant water in and out of the module and is denoted by "A" and "W" respectively. Detailed combustion air and coolant water flow inside the module is disclosed in FIG. 14.

Figure 9:
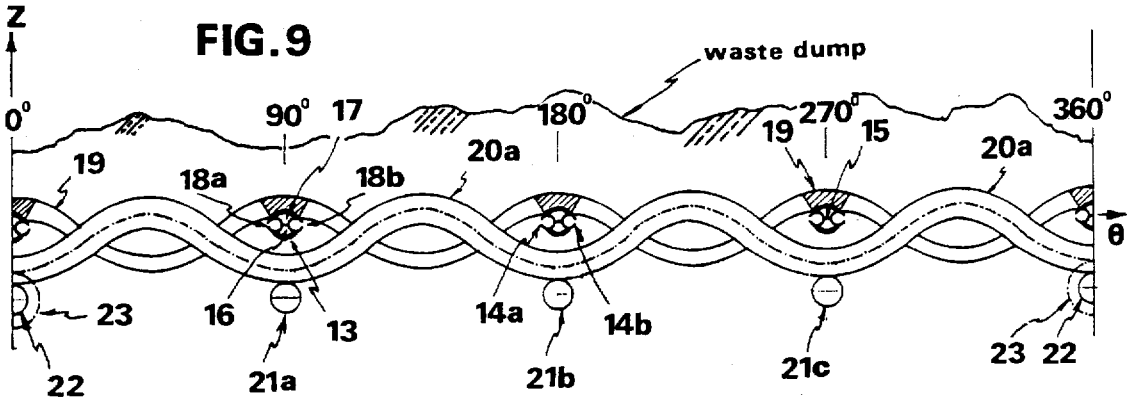
FIG. 9 is a circumferentially-developed schematic longitudinal sectional view showing four-cycle mode embodiments of the stationary grate, air supply pipings, and the first moving grate with first idler shafts having rolling contact groove thereon for simple supports and a drive shaft for rotational drive and support of the first moving grate.

FIG. 9 is a circumferentially-developed schematic longitudinal sectional view showing the structural connection between the four-cycle mode embodiment of the stationary grate 19, four air supply pipings, and the four-cycle mode embodiment of the first moving grate 20*a* with three idler shafts 21*a*,21*b*,21*c* having rolling contact groove thereon for simple supports and the first drive shaft 22 having a drive gear 23 thereon for rotational drive and support of the first moving grate 20*a*, and also showing how MGR agitational motion is made. Here, the abscissa and ordinate indicates angular and axial coordinate respectively and the view is taken from inside of the module towards outside. If driven by the twisting moment of the integral assembly of the first drive shaft 22 and the drive gear 23, then the first moving grate 20*a* is towed in theta direction together with fluctuations in z direction incurred by the rolling contact between the rolling contact groove of the idler shafts 21*a*,21*b*,21*c* and the rolling contact track on the outermost ring of the first moving grate 20*a*. If the drive gear 23 has the positive rotation vector in r direction (into the paper), then the first moving grate 20*a* has the negative rotation vector in z direction when the right hand screw law is adopted under the bevel gear meshing between the drive gear 23 and the geared track on the outermost ring of the first moving grate 20*a*. If sine curve is adopted for the geared track of the first moving grate 20*a*, and also for the upper surface of the stationary grate 19, then the upper surface of the concentric rib rings of the first moving grate 20*a* protrudes above the upper surface of the stationary grate 19 for an angular interval of 45 deg. from 22.5 deg. through 67.5 deg. in the first quarter of one revolution of the first moving grate 20*a* when the first moving grate 20*a* is at the top dead center of its MGR agitational motion. The angular interval of dynamic protrusion is, however, greater than just the magnitude of 45 deg. for each fluctuational cycle of MGR agitation. The idler shafts 21*a*,21*b*,21*c* make axis of rotation for the first moving grate 20*a* by rolling contact between the rolling contact groove of the idler shaft and the rolling contact track on the outermost ring of the first moving grate 20*a* together with the first drive shaft 22 having the drive gear enmeshed with the geared track on the outermost ring of the first moving grate 20*a*. The drive gear 23 and the first drive shaft 22 are fitted together to make an integral drive shaft as by serration or welding on the first drive shaft 22 to transmit the twisting moment applied thereon by rotational drive means. One important design requirement to be met is to keep the normal distance between the center of the idler shaft 21,21*b*,21*c* and the rolling contact track on the outermost ring of the first moving grate 20*a* the same as that between the center of the first drive shaft 22 and the pitch line of the geared track on the outermost ring of the first moving grate 20*a* at any angular position of the rotation of the first moving grate 20*a* in MGR motion. On the other hand, since each air jet vector of the air openings 18*a*,18*b* on the two air pipings 14*a*,14*b* of the air supply piping also clearly shown in FIGS. 4,10 and 14 makes certain angle with horizontal line (horizontal ones shown in FIG. 9) and is spaced radially such that the air jets hit the upper surface of the concentric rib rings of the first moving grate 20*a* so that they not only help burn the waste materials but also prevent waste materials from being stuck in between the lower surface of the air supply piping and the upper surface of the concentric rib rings of the first moving grate 20*a* when the grate is at its top dead centers of its merry-go-round agitational motion. Additionally, the upper surface profile of the stationary grate 19 is of a periodic profile, say sinusoidal profile as shown in FIGS. 4 and 10, extra air supply cavity is inherently provided compared with conventional plain circular plate type fire grate so that higher refuse-air contact area is provided for a specific fire grate planform area without having any agitational means.

Figure 10:
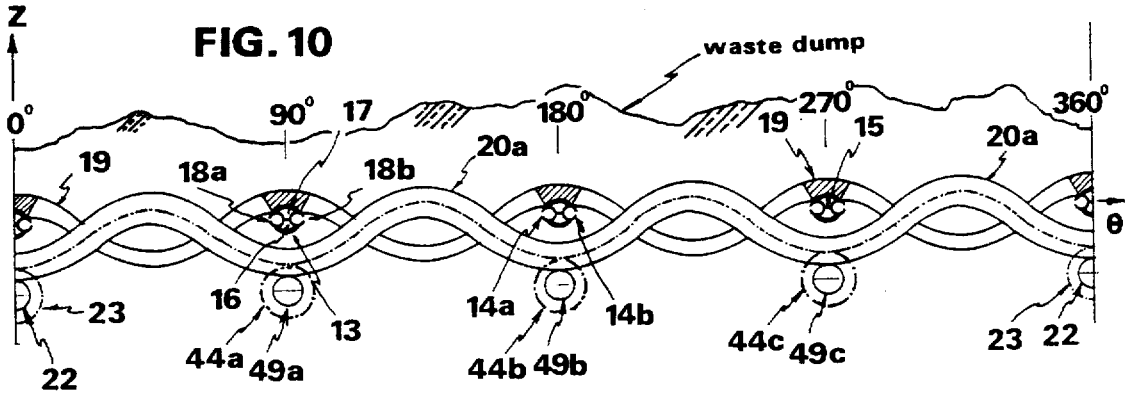
FIG. 10 is a circumferentially-developed schematic longitudinal sectional view showing four-cycle mode embodiments of the stationary grate, air supply pipings, and the first moving grate with alternative embodiment of second idler shafts having an idler gear thereon for simple supports and a drive shaft for rotational drive and support of the first moving grate.

FIG. 10 is a circumferentially-developed schematic longitudinal sectional view showing four-cycle mode embodiments of the stationary grate 10, air supply pipings, and the first moving grate 20*a* with alternative embodiment of second idler shafts 49*a*,49*b*,49*c* having an idler gear 44*a*, 44*b*,44*c* thereon, the idler gear being essentially the same as the drive gear 23, for simple supports and the first drive shaft 22 having a drive gear 23 thereon for rotational drive and support of the first moving grate 20*a*.

Another alternative configuration of the support of the first moving grate 20*a* is made by employing the first idler shaft 21*a*,21*b*,21*c* and the second idler shaft 49*a*,49*b*,49*c* having the idler gear 44*a*,44*b*,44*c* thereon in a combinational fashion for simple support of the first moving grate 20*a* rather than having either the simple support of the first moving grate 20*a* using the first idler shaft 21*a*,21*b*,21*c* or that using the second idler shaft 49*a*,49*b*,49*c* having the idler gear 44*a*,44*b*,44*c*.

Figure 11:
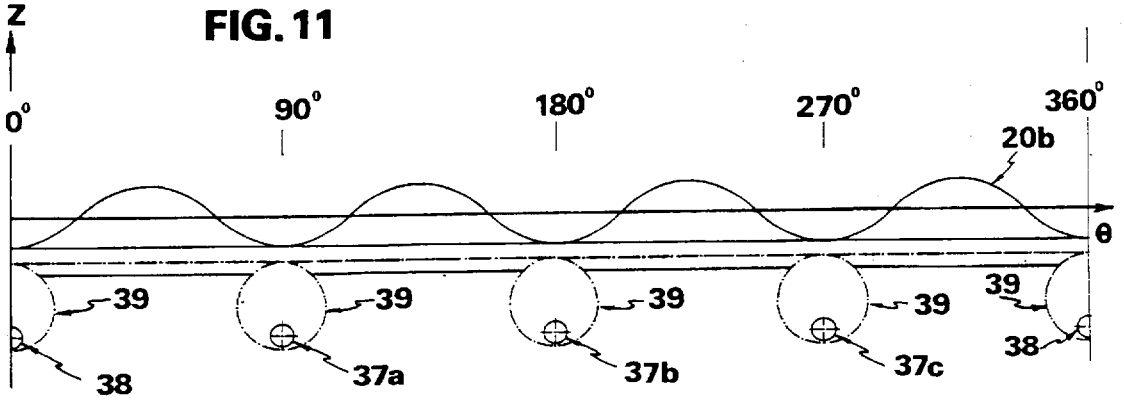
FIG. 11 is a circumferentially-developed schematic longitudinal sectional view disclosing another embodiment to the first moving grate and its second idler and drive shafts having an eccentric gear respectively thereon which can also create 4-cycle mode MGR agitational motion.

FIG. 11 is a circumferentially-developed schematic longitudinal sectional view showing alternative embodiment of the second moving grate 20*b* and three third idler shafts 37*a*,37*b*,37*c* and a second drive shaft 38 with four eccentric gears 39, three on the third idler shafts 37*a*,37*b*,37*c* and one on the second drive shaft 38 in synchronized orientation, thereby the MGR motion can be made. Here, one of the key design requirements to be satisfied is that the sum total of the number of gear teeth on the geared track on the outermost ring of the second moving grate 20*b* be the same as that of gear teeth on each of the eccentric gears 39*a*,39*b*,39*c* times the number of the eccentric gears 39*a*,39*b*,39*c*. One of the advantages of this embodiment of outermost ring of the second moving grate 20*b* over the preceding embodiment of the first moving grate 20*a* is that machining of the geared track on the outermost ring with no z fluctuation is easier than that with sinusoidal fluctuation in that direction while there are some cost-up factors arising from three more eccentric gears 39*a*,39*b*,39*c* together with some assembly complications.

Figure 12:
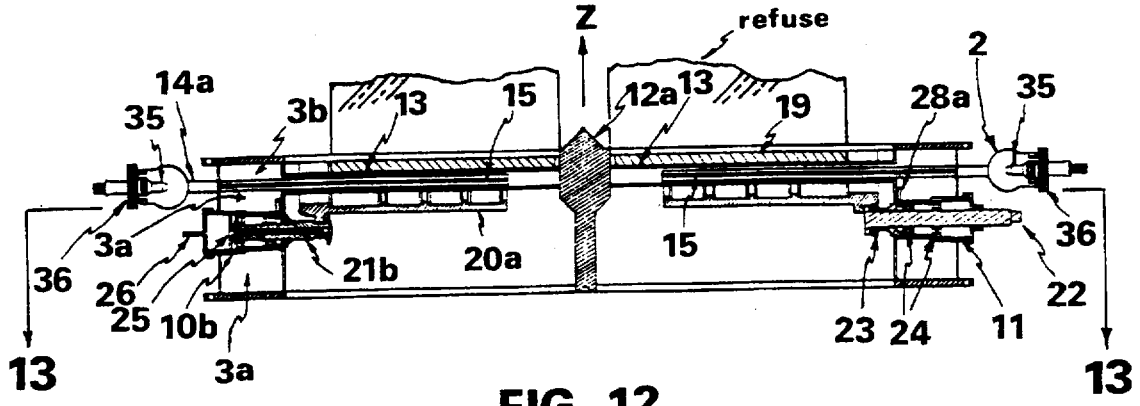
FIG. 12 is a longitudinal sectional view taken through plane 12—12 of FIG. 7.

FIG. 12 is a longitudinal sectional view of the MGR agitation fire grate module of FIG. 7 with the first moving grate 20*a* at the top dead center of its MGR motion and shows modular type fire grate apparatus of water jacket configuration. One of embodiments of the fire grate module in modulation of this fire grate module of this invention is to put exhaust coolant water outlets 34*a*,34*b*,34*c*,34*d* (shown in FIGS. 4, 7, and 8) and intake coolant water inlet 50*a*,50*b*, 50*c*,50*d* (shown in FIG. 13) on the upper and lower ring-shaped flange of the module respectively. This longitudinal section of the modular fire grate apparatus discloses how annular water jacket is divided into an upsteam coolant water jacket 3*a* and a downstream coolant water jacket 3*b* and how the connection between the two coolant water jackets are made through the air supply pipings. Each of the air supply pipings comprises two air pipings 14*a*,14*b* with one end blocked and the other open, the two air pipings having a plurality of air openings 18*a*,18*b* thereon, a baffle strip 15 securing the two air pipings 14*a*,14*b* parallel to each other with the baffle strip 15 in between, and a water piping 13 having a closed cross section on one end and spaced-apart furcations on the other end, the integral body of the two air pipings 14*a*,14*b* and the baffle strip 15 being axially inserted, with the blocked ends of the air pipings 14*a*,14*b* ahead, into the open portion of the furcations and welded together such that the air supply piping has one water piping channel open on one end, a cross section having two water channels, lower water channel 16 and upper water channel 17, and two air passages in the middle, and two air pipings 14*a*,14*b* open on the other end, whereby coolant water in the upstream coolant water jacket 3*a* flows through the lower water channel 16 wherein coolant water flows in −r direction and the other upper water channel 17 wherein which coolant water flows in +r direction (cross section shown in FIGS. 9 and 10; perspective view in FIG. 14) thus coolant water is led from the upstream water jacket 3*a* to the downstream water jacket 3*b* through the lower water channel 16 and then the upper water channel 17 after hitting the junction body 12 and turning around. It is to be noted that there are four fan-shaped baffle plates 43 (also shown in FIGS. 9,10, and 14) at the same elevation of the baffle strip 15 which divide the upstream coolant water jacket 3*a* and the downstream coolant water jacket 3*b*. Referring temporarily to FIG. 2, the coolant water connection of the modular fire grate apparatus to the lower water jacket 6 of the ash discharge lower body and a upper water jacket 4 of the upper cylindrical incineration chamber body is made through four lower water channel brackets 7*a*,7*b*,7*c*,7*d* and four upper water channel brackets 5*a*,5*b*,5*c*,5*d* respectively with four pieces each of flat ring type washers for watertight seal in between a lower flange of the upper incineration chamber body and the upper ring-shaped flange of the module and between an upper flange of the ash discharge lower body and the lower ring-shaped flange of the module respectively in this embodiment of 4-cycle mode fire grate module. Also one each of ring type gasket is to be placed in each of the upper and lower flange coupling for hermetic seal as well as for watertightness. Meanwhile, a clean-up access blind flange 45 (shown in FIG. 14) at each junction of the axis of air supply piping and the air plenum 2 provides air piping cleaning capability and an air piping cleaning opening on the air plenum 2 can accept a burning-agent spray nozzle assembly (shown in FIGS. 1,4,7, and 14) comprising a burning-agent spray nozzle mounting bracket 36 and two burning-agent spray nozzles 35 for admission of burning agent into the incineration chamber through air openings 18*a*,18*b* on the air pipings 14*a*,14*b* of the air supply piping after replacing the clean-up access blind flange 45 with the burning-agent spray nozzle assembly on which two fuel spray nozzles 35 or one aggregate of two burning-agent spray nozzles are/is mounted such that the two nozzle tips align with the axis of each air piping 14*a*,14*b* of the air supply piping. The burning-agent supply rate into the incineration chamber may be controlled by the so-called percent ON time as well as by the variation of overall burning-agent flow rate. Burning-agent mists or droplets staying in the air plenum 2 caught on fire may be prevented as by cyclic fuel supply method such as the so-called percent ON time control for each burning-agent spray nozzle assembly. The burning as by burners adopted in conventional cincinerators can be eliminated with this burning-agent spray nozzle assembly and feed-in methods together with burning-agent pump.

Figure 13:
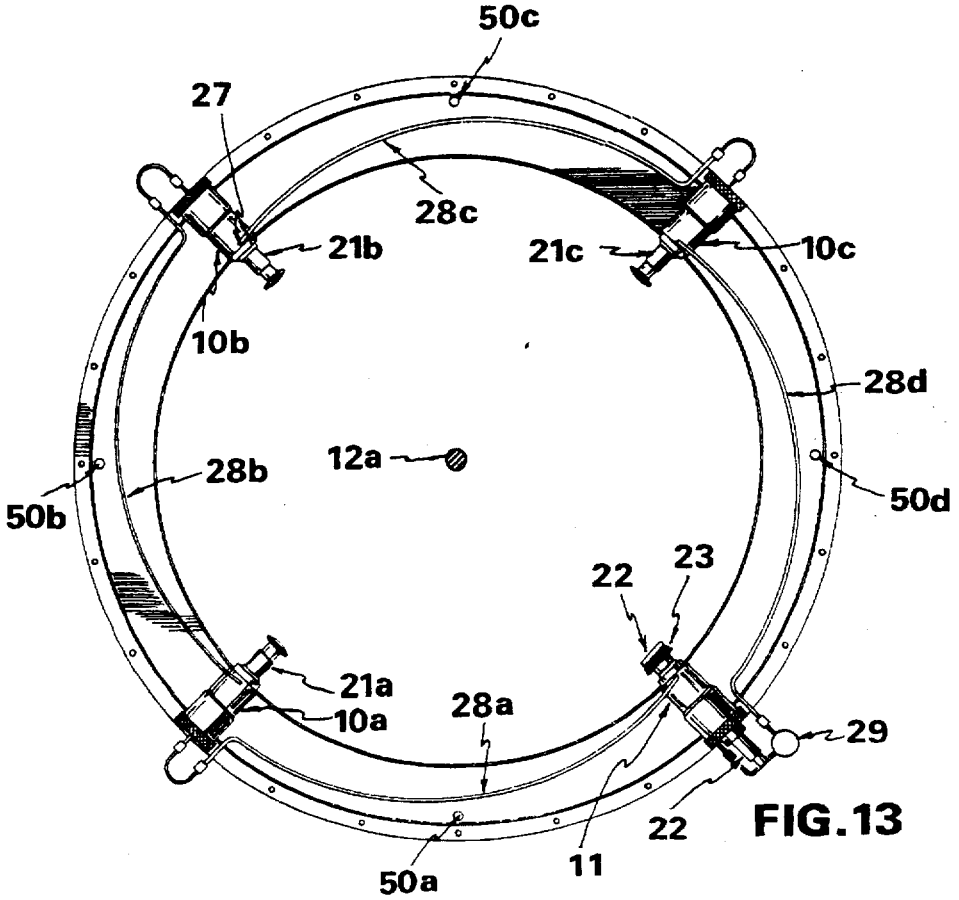
FIG. 13 is a cross sectional view of the fire grate module showing layout of three idler shaft assemblies, a drive shaft assembly and four cooler tubings connecting them, and is taken through plane 13—13 of FIG. 12.

The cross-sectional view of the lower portion of the MGR agitation fire grate module of which the top plan view and longitudinal sectional view shown in FIGS. 7 and 12 respectively is disclosed in FIG. 13. This figure reveals foru-cycle mode layout of the idler shaft housings 10*a*,10*b*,10*c* and the drive shaft housing 11 with each of the three first idler shafts 21*a*,21*b*,21*c* and an assembly of the drive gear 23 and the first drive shaft 22 fitted therein respectively, how the coolant lubricant is, after being heated up in each of the idler shaft housings 10*a*,10*b*,10*c* and the drive shaft housing 11, cyclically cooled down while passing through cooler tubings 28*a*,28*b*,28*c*,28*d* connecting the idler shaft housing 10*a*,10*b*, 10*c* and the drive shaft housing 11 clockwise, and how they are interconnected in the upstream coolant water jacket 3*a* of this modular fire grate apparatus. Filtering for coolant lubricant can be made by placing a lubricant filter 29. Referring now back to a longitudinal sectional view in FIG. 12 showing the configuration of the idler shaft housing lob, the first idler shaft 21*b*, and a cooling impeller 25, together with a partially cut-away perspective view of the idler shaft 25*a*,25*b*,25*c* and a perspective view of the cooling impeller 25 shown in FIG. 16, the inside cavity of each of the idler shaft housing 10*a*,10*b*,10*c* is divided by the cooling impeller 25 into a cold chamber and a hot chamber, each having a lubricant intake port 26 to which cold end of the cooler tubing 28*a*,28*b*,28*c* is connected and a lubricant exhaust port 27 to which hot end of the cooler tubing 28*a*,28*b*,28*c* is connected respectively as with tube fitting so that cold coolant lubricant is fed by the pumping force of the cooling impeller 25 rotationally driven by the rotation of the first moving grate 20*a* into the cold chamber, driven along the the central capillary passage in the negative r direction of the cooling impeller 25, turned around and flown back in the positive r direction along the annular passage formed by fitting of the cooling impeller 25 into the central axial cavity of each of the idler shaft 21,49,37 while cooling the idler shafts, forwarded into the hot chamber, and then finally driven out through the lubricant exhaust port 27 to which hot end of each of the lubricant cooler tubings 28*a*,28*b*,28*c*,28*d* is connected as with tube fittings.

Figure 14:
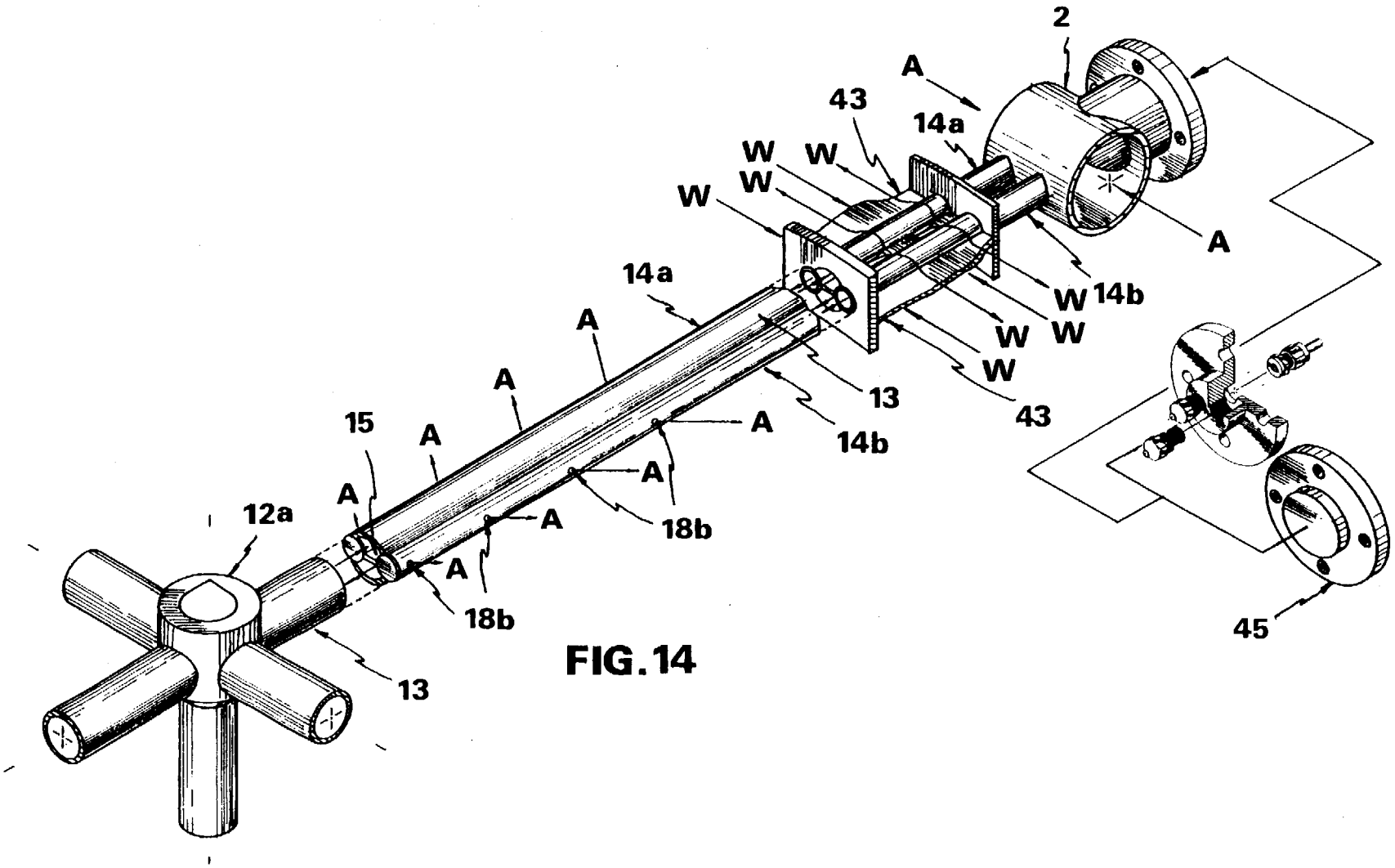
FIG. 14 is a perspective view showing a four-cycle mode preferred embodiment of the configuration of the air supply pipings, inner and outer shell portions of coolant water jacket, segmental air plenum, an air piping cleaning opening, a clean-up access blind flange, and a burning-agent spray nozzle assembly together with pressurized air and coolant water flow passages according to the present invention.

FIG. 14 is a perspective view showing the configuration of the air supply piping according to a four-cycle mode modular embodiment of the invention together with air and coolant water flow passages. The annular coolant water jacket of the fire grate module is divided into two coolant water jackets, the upstream coolant water jacket 3*a* and the downstream coolant water jacket 3*b* by four pieces of the baffle strip 15, the air pipings 14*a*,14*b* of the air supply pipings, and the four fan-shaped baffle plate 43 at the same elevation of the fan-shaped baffle plates. The temperature of the coolant water in the downstream coolant water jacket 3*b* is obvious to be higher than that in the upstream coolant water jacket 3*a* because the incineration waste heat is being transferred to the coolant water as the water flows through the lower channel 16 and the upper channel 17 due to the pressure difference between the upstream coolant water jacket 3*a* and the downstream coolant water jacket 3*b* caused by the pumping pressure of the coolant water circulation pump 42. On the other hand, the combustion air admission is made from the air plenum 2 into the incineration chamber above the stationary grate 19 through air openings 18*a*,18*b* on the pair pipings 14*a*,14*b* of the air supply pipings.

Figure 15:
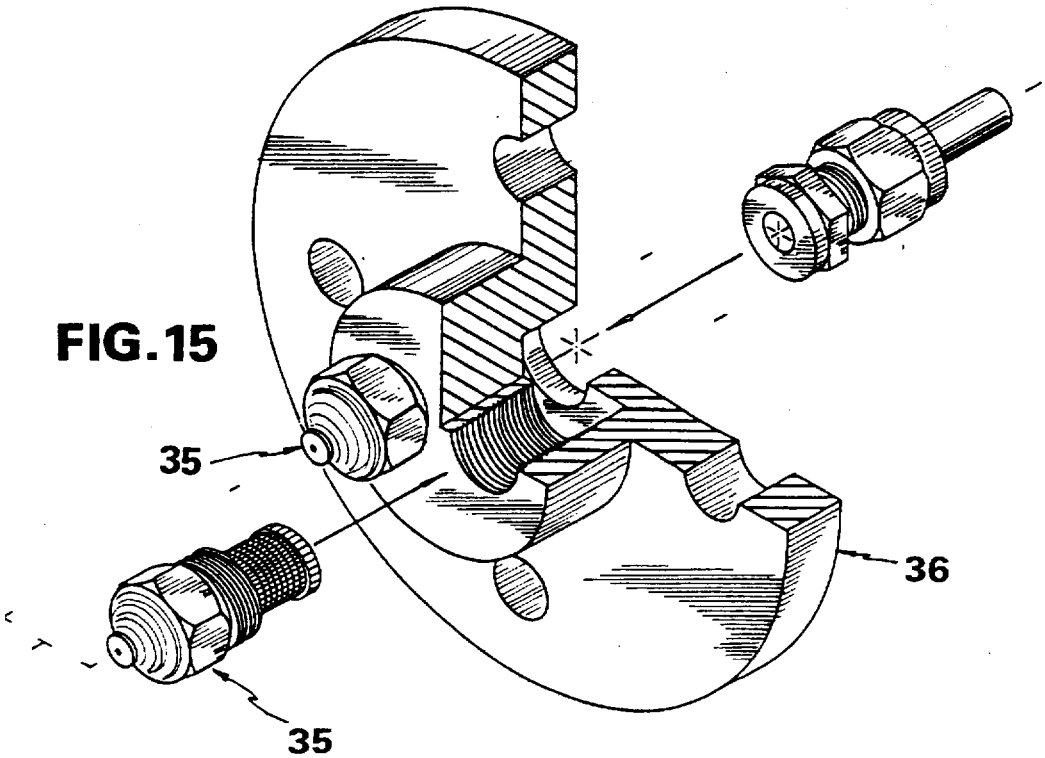
FIG. 15 is a perspective view of a preferred embodiment of a burning-agent spray nozzle assembly with two burning-agent spray nozzles thereon.

FIG. 15 is a perspective view of the burning-agent spray nozzle mounting bracket 36 with two burning-agent spray nozzles 35 mounted thereon. No conventional burners are used in this invention. Instead, the burning-agent spray nozzle assembly together with a burning agent pump having burning-agent distributing means replaces the conventional burner. The axis of each of the burning-agent spray nozzles 35 aligns with that of each of the two air pipings 14*a*,14*b* of the air supply piping so that when burning agent is sprayed through the burning-agent spray nozzle assembly, then the mixture of the combustion air and burning agent mists is supplied into the air pipings 14*a*,14*b* of the air supply piping and admitted into the incineration chamber through the air openings 18*a*,18*b*. The cyclic injection of burning agent into the interior of the air pipings 14*a*,14*b* of the air supply piping lessens the heat build-up of the air pipings 14*a*,14*b* of the air supply piping. In the four-cycle mode embodiment of the fire grate apparatus, 25 or less percent ON time injection is believed to be desirable. There are many parameters involved in this fuel feed-in method, say, burning-agent flow rate per assembly, percent ON time, multi-cyclic spray, etc. as the number of the MGR agitation cycle of the fire grate apparatus increases.

Figure 16:
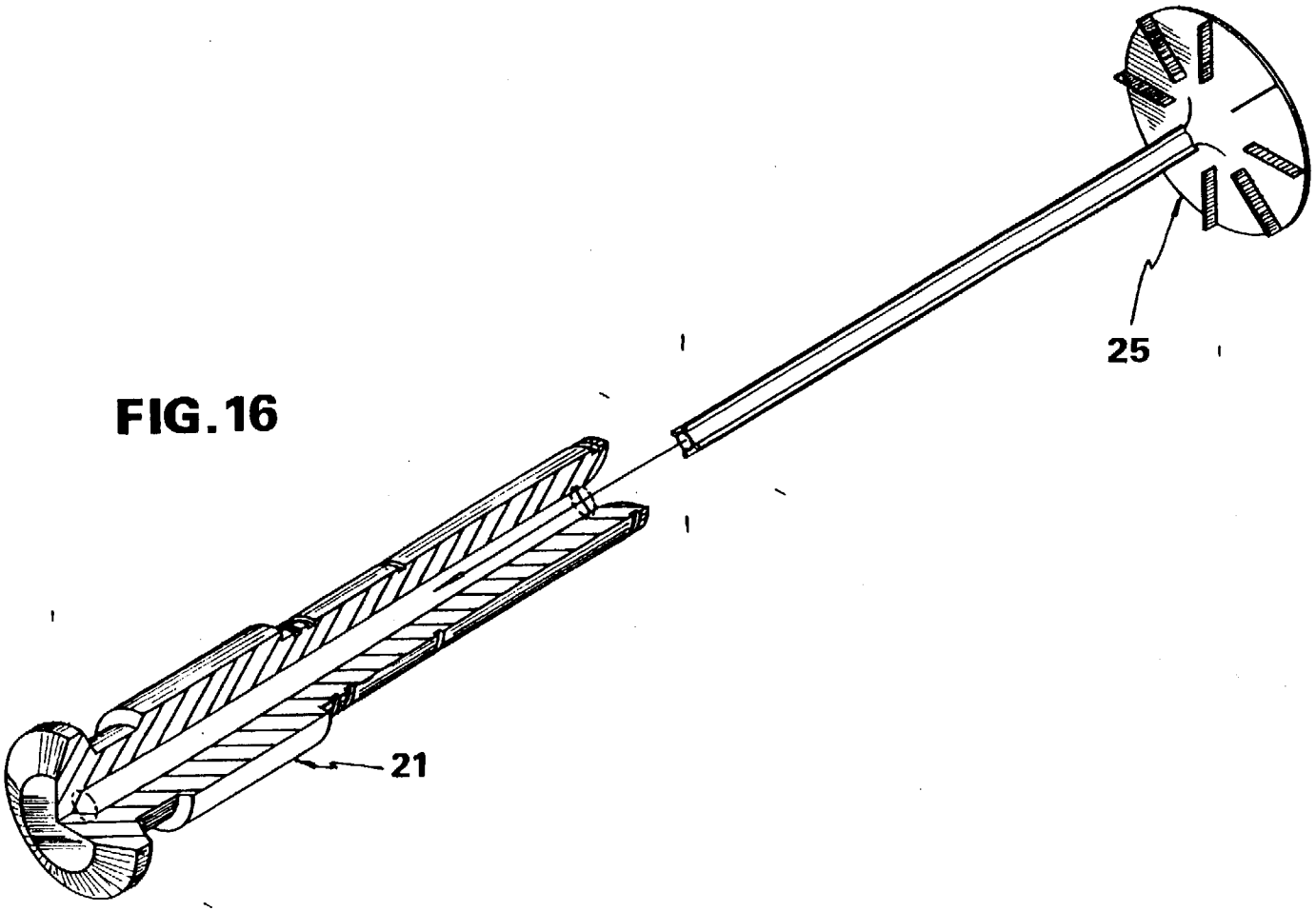
FIG. 16 shows perspective view of an embodiment of the idler shaft having rolling contact groove thereon and of a cooling impeller being plugged into the central axial cavity of the idler shaft respectively according to this invention.

FIG. 16 shows perspective views of an embodiment of the first idler shaft 21*a*,21*b*,21*c* and of the cooling impeller 25 to be inserted therein. Since it is required that the shaft be cooled down in order to prevent bending in permanent set due to creep phenomenon when the idler shaft under lateral directional load is exposed to high furnace operating temperature for an elongated period of time, the idler shaft has been embodied hollow such that the cooling impeller 25 can be inserted therein so that the rotation of the idler shaft results in the rotation of the cooling impeller 25, thus producing pumping power for circulation of the coolant lubricant coming out of the central axial cavity of the idler shaft through the annular passage due to the centrifugal forces caused by the rotation of the cooling impeller 25 with a plurality of blades thereon.

Figure 17:
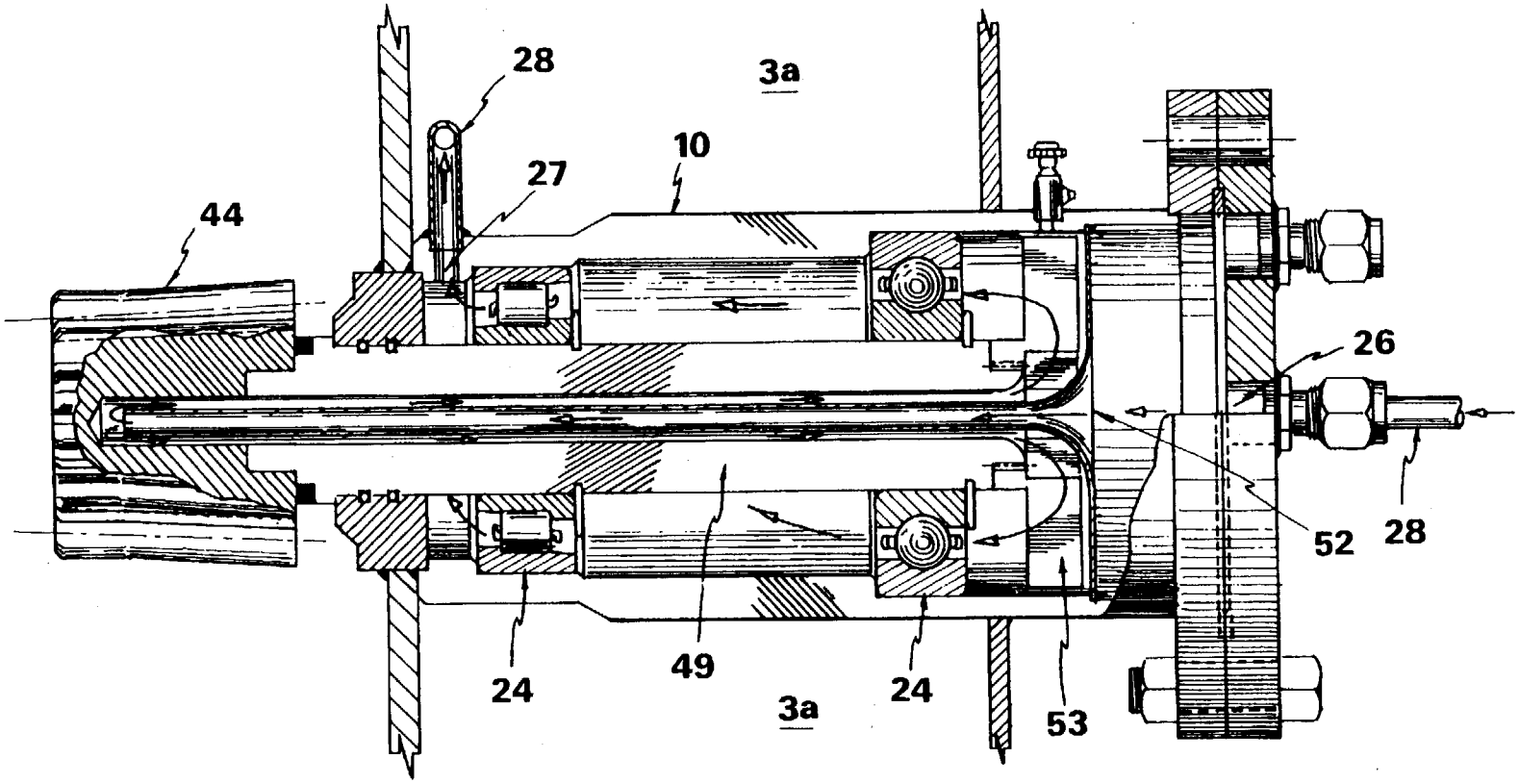
FIG. 17 discloses an alternative prefered embodiment of idler shaft assembly comprising the idler shaft housing, a fourth idler shaft having the idler gear thereon, an impeller, and a trumpet-shaped divider plate.

FIG. 17 discloses an alternative preferred embodiment of idler shaft assembly comprising the idler shaft housing 10, a fourth idler shaft 49 having the idler gear 44 thereon, an impeller 53 being secured to open end of the idler shaft composed of the fourth idler shaft 49 and the idler gear 44, two bearings 24 for supporting the fourth idler shaft 49, a trumpet-shaped divider plate 52 being secured to the inside cavity of the idler shaft housing 10. This partially cutaway view discloses how the fourth idler shaft 49 having the idler gear 44 thereon and the two bearings 24 are cooled by coolant lubricant with an alternative embodiment to the cooling impeller 25 of FIG. 16 and also how the idler shaft housing assembly is cooled by coolant water in the upstream coolant water jacket 3*a*. The inside cavity of the idler shaft housing wherein coolant lubricant is filled up is divided into the hot chamber and the cold chamber by the trumpet-shaped divider plate 52. This figure also discloses how hot end of the cooler tubing 28 and cold end of another cooler tubing 28 is connected to the hot and cold chamber through the lubricant exhaust port 27 and the lubricant intake port 26 respectively.

Figure 18:
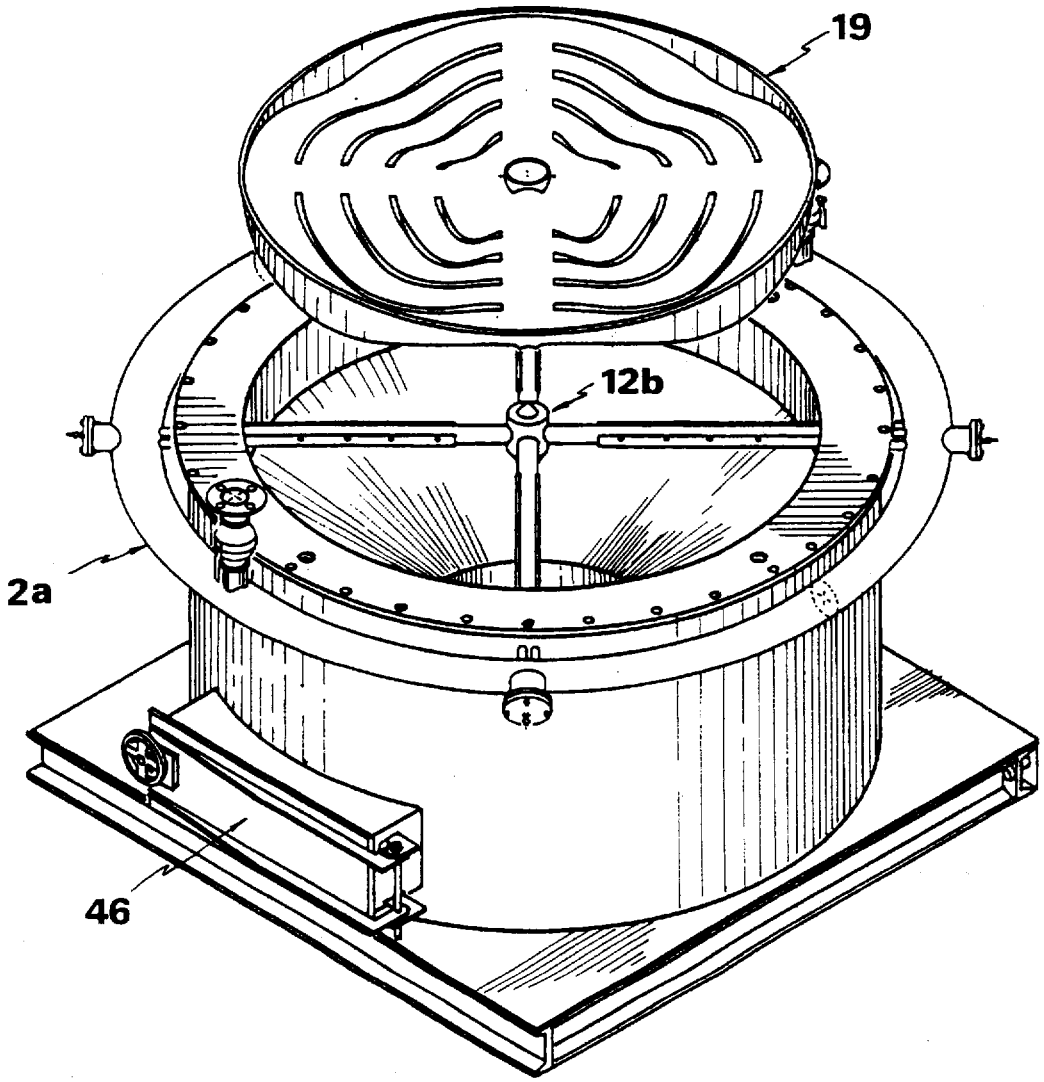
FIG. 18 is a bird's eye view of an integral fire grate apparatus with air supply.

Finally, FIG. 18 is a bird's eye view of an alternative four-cycle mode embodiment of an integral fire grate apparatus without agitational mechanism. This integral modular fire grate apparatus comprises three air supply pipings, coolant water jacket, a second junction body 12*a*, a second air plenum 2*a* encircling outer shell of the coolant water jacket, and a stationary grate 19 being mounted on the three air supply pipings from above.

According to the present invention as described above in detail, agitational function has been provided to the fire grate apparatus with constant magnitude of agitation in r direction as well as with semi-axisymmetry in circumferential direction on top of air supply function to the fire grate apparatus itself. More thorough air supply even into the dumped refuse is possible with this MGR agitational mechanism, resulting in increased incineration capacity, improved combustion efficiency, and the provision of improved angular symmetry of incineration, of distribution of thermal stresses in the inner shell material of the incineration chamber, and of burning with angularly scattered burning agent distribution. Another advantage of this invention over the conventional fire grate is that the waste volume reduction performance with this concentric fire grate structure is believed obvious to be significantly improved so that only ashes and incombustible substances contained in the refuse dump which are smaller in size than the ash sifting gap made when the stationary grate 19 and the moving grate 20*a*,20*b* are paired with each other, and liquid droplets are discharged downward. A more thorough angular symmetry is obtained as the number of cycles of MGR fluctuation a revolution of the moving grate 20*a*,20*b* is increased.

While the specific embodiment of the invention described is for four-cycle mode fire grate apparatus, it is believed obvious to those skilled in the art that the higher cycle mode MGR agitation or single grate type incinerator fire grate apparatus without agitational mechanism can readily be constructed for higher incineration capacity or for specific requirements of the characteristics of waste materials to be incinerated. Specifically, like conventional incinerator furnaces without agitational function for the fire grate, drive motor, MGR agitational structure comprising the moving grate, its drive and simple cantilever support idler shafts together with their housings, the cooling impeller, and the cooler tubings may be deleted so that there is only stationary grate remaining on the integral fire grate apparatus and ash discharge lower body combined.

Having described four-cycle mode embodiment of the fire grate apparati according to the present invention, it is believed obvious that other modifications and variations will be suggested to those skilled in the art in the light of the above teachings, it is therefore to be understood that changes may be made in the particular embodiment of the invention described which are within the full intended scope of the invention as defined by the appended claims.

What is claimed is:

1. A modular fire grate apparatus for use in incinerator furnaces, the apparatus comprising:

(a) at least three air supply pipings, each of which comprises two air pipings with one end blocked and the other open, the two air pipings having a plurality of air openings thereon, a baffle strip securing the two air pipings parallel to each other with the baffle strip in between, and a water piping having a closed cross section on one end and spaced-apart furcations on the other end, the integral body of the two air pipings and the baffle strip being axially inserted, with the blocked ends of the air pipings ahead, into the open portion of the furcations and welded together such that the air supply piping has one water piping channel open on one end, a cross section having two water channels and two air passages in the middle, and two air pipings open on the other end;

(b) an annular coolant water jacket divided into upstream and downstream coolant water jackets, the upstream and downstream water jacket having an intake coolant water inlet and an exhaust coolant water outlet respectively, the annular coolant water jacket being defined by means comprising a lower ring-shaped flange, an inner shell having a plurality of openings thereon for the air supply pipings and being welded to the lower flange, an outer shell having a plurality of openings thereon to let the air pipings of the air supply pipings pass through and being welded to the lower flange, the openings on the inner and outer shells being spaced at an angular interval at the same elevation so that each of the air supply pipings can be welded to the outer shell as well as to the inner shell past the opening on the inner shell, a plurality of fan-shaped baffle plates, each of which is placed horizontally in between the inner and outer shells and one air piping each of the two angularly neighboring air supply pipings and at the same elevation as the elevation of the baffle strip, and is secured there such that the coolant water in the upstream water jacket has its outlet through one water channel of each of the air supply pipings, and an upper ring-shaped flange being welded to the upper ends of the inner and outer shells;

(c) a first junction body placed at the center of the annular coolant water jacket, each of the air supply pipings being welded to the junction body such that negative radial end of each of the air supply pipings is blocked;

(d) air plenum means for supplying pressurized air into each of the air pipings of the air supply pipings, the plenum means comprising an air plenum encircling the outer shell and at least one air intake piping having a mounting flange on one end, the other end of the air intake piping being welded to the air plenum;

(e) a first moving grate having circular-planform rib rings whose upper surface contour profile repeated as many times as the number of air supply pipings in the circumferential direction is of a periodic fluctuational profile, the planform circle of each of the rib rings being in alignment with radial position of the air opening on the air piping of the air supply pipings, and an outermost ring having a geared track and a rolling contact track thereon with the same profile as that of the upper surface contour of the rib rings of the first moving grate, the upper surface contour profile of the rib rings and the upper surface contour profile of the outermost ring being in phase with each other, the rib rings and the outermost ring being secured to each other by a plurality of radially arranged members to provide the rib rings and the outermost ring with concentricity;

(f) at least two idler shaft assemblies for supporting the first moving grate and maintaining the axis of the rotation thereof, each of the idler shaft assemblies comprising a first idler shaft, the idler shaft being hollow, at least two bearings, and an idler shaft housing wherein the idler shaft and the bearings are accommodated, the idler shaft housing being welded to the the inner and outer shells such that the idler shaft housing is placed below the air supply piping;

(g) a first drive shaft assembly for supporting the first moving grate and providing the first moving grate with a merry-go-round agitational motion together with the idler shaft assemblies while maintaining the axis of rotation of the first moving grate when the first moving grate is rotationally driven, the drive shaft assembly comprising a drive shaft with a drive gear thereon, at least two bearings, and a drive shaft housing wherein the drive shaft and the bearings are accommodated, the drive shaft housing being welded to the the inner and outer shells such that the drive shaft housing is placed below the air supply piping;

(h) a rotational drive means for rotation of the drive shaft, the drive means being connected to the drive shaft; and (i) a stationary grate for supporting burning fuel thereon, the stationary grate having concentric rings whose upper surface contour profile repeated for each angular sector confined by the two angularly neighboring air supply pipings is of a periodic fluctuational profile, and being mounted on the air supply pipings, the radially neighboring two concentric rings of the stationary grate being spaced such that each of the concentric rib rings of the first moving grate protrudes cyclically above the upper surface contour of the stationary grate through the gap between the two radially neighboring concentric rings of the stationary grate when the first moving grate is paired from underneath the air supply pipings with the stationary grate mounted on the air supply pipings and rotationally driven by the drive shaft.

2. The fire grate apparatus of claim 1, further comprising:

(a) means for cooling the surface of the central axial cavity of the first idler shaft; and (b) a cooler tubing for connecting the hot chamber of the idler shaft housing and the cold chamber of another idler shaft housing, the cooler tubing being placed in the upstream coolant water jacket so that cooling of heated coolant lubricant in the cooler tubing is made by coolant water in the upstream coolant water jacket.

3. The apparatus of claim 2, further comprising an air flow rate control valve mounted on the air plenum means.

4. The apparatus of claim 3, wherein a plurality of air piping cleaning openings with a clean-up access blind flange thereon are provided to outer region of the air plenum means such that the accessability into the interior of the air pipings of the air supply piping can be provided through the air piping cleaning opening.

5. The apparatus of claim 4, wherein a burning-agent spray nozzle assembly with at least one burning-agent spray nozzle mounted thereon is provided to the air piping cleaning openings after taking the clean-up access blind flange off the air piping cleaning opening so that burning agent can be admitted into the air piping of the air supply piping through the burning-agent spray nozzle.

6. The apparatus of claim 5, wherein the burning-agent spray nozzle is mounted such that the nozzle tip of the burning-agent spray nozzle aligns with each axis of the two air pipings of the air supply piping.

7. The apparatus of claim 5, wherein burning-agent spray is made such that the burning-agent spray into at least one air piping of each of the air supply pipings is made in cyclic fashion.

8. The apparatus of claim 1, wherein at least one of the first idler shafts is replaced with a second idler shaft having an idler gear thereon, the second idler shaft being hollow, so that the idler gear can be enmeshed with the geared track on the outermost ring of the first moving grate.

9. The fire grate apparatus of claim 8, further comprising:

(a) means for cooling the surface of the central axial cavity of the idler shaft; and (b) a cooler tubing for connecting the hot chamber of the idler shaft housing and the cold chamber of another idler shaft housing, the cooler tubing being placed in the upstream coolant water jacket so that cooling of heated coolant lubricant in the cooler tubing is made by coolant water in the upstream coolant water jacket.

10. The apparatus of claim 9, further comprising an air flow rate control valve mounted on the air plenum means.

11. The apparatus of claim 10, wherein a plurality of air piping cleaning openings with a clean-up access blind flange thereon are provided to outer region of the air plenum means such that the accessability into the interior of the air pipings of the air supply piping can be provided through the air piping cleaning opening.

12. The apparatus of claim 11, wherein a burning-agent spray nozzle assembly with at least one burning-agent spray nozzle mounted thereon is provided to the air piping cleaning openings after taking the clean-up access blind flange off the air piping cleaning opening so that burning agent can be admitted into the air piping of the air supply piping through the burning-agent spray nozzle.

13. The apparatus of claim 12, wherein the burning-agent spray nozzle is mounted such that the nozzle tip of the burning-agent spray nozzle aligns with each axis of the two air pipings of the air supply piping.

14. The apparatus of claim 12, wherein burning-agent spray is made such that the burning-agent spray into at least one air piping of each of the air supply pipings is made in cyclic fashion.

15. A modular fire grate apparatus for use in incinerator furnaces, the apparatus comprising:

(a) at least three air supply pipings, each of which comprises two air pipings with one end blocked and the other open, the two air pipings having a plurality of air openings thereon, a baffle strip securing the two air pipings parallel to each other with the baffle strip in between, and a water piping having a closed cross section on one end and spaced-apart furcations on the other end, the integral body of the two air pipings and the baffle strip being axially inserted, with the blocked ends of the air pipings ahead, into the open portion of the furcations and welded together such that the air supply piping has one water piping channel open on one end, a cross section having two water channels and two air passages in the middle, and two air pipings open on the other end;

(b) an annular coolant water jacket divided into upstream and downstream coolant water jackets, the upstream and downstream water jacket having an intake coolant water inlet and an exhaust coolant water outlet respectively, the annular coolant water jacket being defined by means comprising a lower ring-shaped flange, an inner shell having a plurality of openings thereon for the air supply pipings and being welded to the lower flange, an outer shell having a plurality of openings thereon to let the air pipings of the air supply pipings pass through and being welded to the lower flange, the openings on the inner and outer shells being spaced at an angular interval at the same elevation so that each of the air supply pipings can be welded to the outer shell as well as to the inner shell past the opening on the inner shell, a plurality of fan-shaped baffle plates, each of which is placed horizontally in between the inner and outer shells and one air piping each of the two angularly neighboring air supply pipings and at the same elevation as the elevation of the baffle strip, and is secured there such that the coolant water in the upstream water jacket has its outlet through one water channel of each of the air supply pipings, and an upper ring-shaped flange being welded to the upper ends of the inner and outer shells;

(c) a first junction body placed at the center of the annular coolant water jacket, each of the air supply pipings being welded to the junction body such that negative radial end of each of the air supply pipings is blocked;

(d) air plenum means for supplying pressurized air into each of the air pipings of the air supply pipings, the plenum means comprising an air plenum encircling the outer shell and at least one air intake piping having a mounting flange on one end, the other end of the air intake piping being welded to the air plenum;

(e) a second moving grate having circular-planform rib rings whose upper surface contour profile repeated as many times as the number of air supply pipings in the circumferential direction is of a periodic fluctuational profile, the planform circle of each of the rib rings being in alignment with radial position of the air opening on the air piping of the air supply pipings, the upper surface contour profile of each of the concentric rib rings being in phase with each other, and an outermost ring having a geared track thereon, the rib rings and the outermost ring being secured to each other by a plurality of radially arranged members to provide the rib rings and the outermost ring with concentricity;

(f) at least two idler shaft assemblies for supporting the second moving grate and maintaining the axis of the rotation thereof, each of the idler shaft assemblies comprising a third idler shaft with an eccentric gear thereon, the idler shaft being hollow, at least two bearings, and an idler shaft housing wherein the idler shaft and the bearings are accommodated, the idler shaft housing being welded to the the inner and outer shells such that the idler shaft housing is placed below the air supply piping;

(g) a second drive shaft assembly for supporting the second moving grate and providing the second moving grate with a merry-go-round agitational motion together with the idler shaft assemblies while maintaining the axis of rotation of the second moving grate when the second moving grate is rotationally driven, the drive shaft assembly comprising a second drive shaft with an eccentric drive gear thereon, the drive gear being essentially the same as the eccentric gear on the idler shaft, at least two bearings, and a drive shaft housing wherein the drive shaft and the bearings are accommodated, the drive shaft housing being welded to the the inner and outer shells such that the drive shaft housing is placed below the air supply piping, the eccentric gears on the idler shafts and on the drive shaft being in synchronized fashion when enmeshed with the geared track on the outermost ring of the second moving grate;

(h) a rotational drive means for rotation of the drive shaft, the drive means being connected to the drive shaft; and (i) a stationary grate for supporting burning fuel thereon, the stationary grate having concentric rings whose upper surface contour profile repeated for each angular sector confined by the two angularly neighboring air supply pipings is of a periodic fluctuational profile, and being mounted on the air supply pipings, the radially neighboring two concentric rings of the stationary grate being spaced such that each of the concentric rib rings of the second moving grate protrudes cyclically above the upper surface contour of the stationary grate through the gap between the two radially neighboring concentric rings of the stationary grate when the second moving grate is paired from underneath the air supply pipings with the stationary grate mounted on the air supply pipings and rotationally driven by the drive shaft.

16. The fire grate apparatus of claim 15, further comprising:

(a) means for cooling the surface of the central axial cavity of the third idler shaft; and (b) a cooler tubing for connecting the hot chamber of the idler shaft housing and the cold chamber of another idler shaft housing, the cooler tubing being placed in the upstream coolant water jacket so that cooling of heated coolant lubricant in the cooler tubing is made by coolant water in the upstream coolant water jacket.

17. The apparatus of claim 16, further comprising an air flow rate control valve mounted on the air plenum means.

18. The apparatus of claim 17, wherein a plurality of air piping cleaning openings with a clean-up access blind flange thereon are provided to outer region of the air plenum means such that the accessability into the interior of the air pipings of the air supply piping can be provided through the air piping cleaning opening.

19. The apparatus of claim 18, wherein a burning-agent spray nozzle assembly with at least one burning-agent spray nozzle mounted thereon is provided to the air piping cleaning openings after taking the clean-up access blind flange off the air piping cleaning opening so that burning agent can be admitted into the air piping of the air supply piping through the burning-agent spray nozzle.

20. The apparatus of claim 19, wherein the burning-agent spray nozzle is mounted such that the nozzle tip of the burning-agent spray nozzle aligns with each axis of the two air pipings of the air supply piping.

21. The apparatus of claim 19, wherein burning-agent spray is made such that the burning-agent spray into at least one air piping of each of the air supply pipings is made in cyclic fashion.

22. The apparatus of claim 1, wherein the first idler shaft is of solid type.

23. The apparatus of claim 22, further comprising an air flow rate control valve mounted on the air plenum means.

24. The apparatus of claim 23, wherein a plurality of air piping cleaning openings with a clean-up access blind flange thereon are provided to outer region of the air plenum means such that the accessability into the interior of the air pipings of the air supply piping can be provided through the air piping cleaning opening.

25. The apparatus of claim 24, wherein a burning-agent spray nozzle assembly with at least one burning-agent spray nozzle mounted thereon is provided to the air piping cleaning openings after taking the clean-up access blind flange off the air piping cleaning opening so that burning agent can be admitted into the air piping of the air supply piping through the burning-agent spray nozzle.

26. The apparatus of claim 25, wherein the burning-agent spray nozzle is mounted such that the nozzle tip of the burning-agent spray nozzle aligns with each axis of the two air pipings of the air supply piping.

27. The apparatus of claim 25, wherein burning-agent spray is made such that the burning-agent spray into at least one air piping of each of the air supply pipings is made in cyclic fashion.

28. The apparatus of claim 8, wherein each of the first idler shaft and the second idler shaft is of solid type.

29. The apparatus of claim 28, further comprising an air flow rate control valve mounted on the air plenum means.

30. The apparatus of claim 29, wherein a plurality of air piping cleaning openings with a clean-up access blind flange thereon are provided to outer region of the air plenum means such that the accessability into the interior of the air pipings of the air supply piping can be provided through the air piping cleaning opening.

31. The apparatus of claim 30, wherein a burning-agent spray nozzle assembly with at least one burning-agent spray nozzle mounted thereon is provided to the air piping cleaning openings after taking the clean-up access blind flange off the air piping cleaning opening so that burning agent can be admitted into the air piping of the air supply piping through the burning-agent spray nozzle.

32. The apparatus of claim 31, wherein the burning-agent spray nozzle is mounted such that the nozzle tip of the burning-agent spray nozzle aligns with each axis of the two air pipings of the air supply piping.

33. The apparatus of claim 31, wherein burning-agent spray is made such that the burning-agent spray into at least one air piping of each of the air supply pipings is made in cyclic fashion.

34. The apparatus of claim 15, wherein the third idler shaft is of solid type.

35. The apparatus of claim 34, further comprising an air flow rate control valve mounted on the air plenum means.

36. The apparatus of claim 35, wherein a plurality of air piping cleaning openings with a clean-up access blind flange thereon are provided to outer region of the air plenum means such that the accessability into the interior of the air pipings of the air supply piping can be provided through the air piping cleaning opening.

37. The apparatus of claim 36, wherein a burning-agent spray nozzle assembly with at least one burning-agent spray nozzle mounted thereon is provided to the air piping cleaning openings after taking the clean-up access blind flange off the air piping cleaning opening so that burning agent can be admitted into the air piping of the air supply piping through the burning-agent spray nozzle.

38. The apparatus of claim 37, wherein the burning-agent spray nozzle is mounted such that the nozzle tip of the burning-agent spray nozzle aligns with each axis of the two air pipings of the air supply piping.

39. The apparatus of claim 37, wherein burning-agent spray is made such that the burning-agent spray into at least one air piping of each of the air supply pipings is made in cyclic fashion.

40. A fire grate apparatus for use in incinerator furnaces, the apparatus comprising:

(a) at least three air supply pipings, each of which comprises two air pipings with one end blocked and the other open, the two air pipings having a plurality of air openings thereon, a baffle strip securing the two air pipings parallel to each other with the baffle strip in between, and a water piping having a closed cross section on one end and spaced-apart furcations on the other end, the integral body of the two air pipings and the baffle strip being axially inserted, with the blocked ends of the air pipings ahead, into the open portion of the furcations and welded together such that the air supply piping has one water piping channel open on one end, a cross section having two water channels and two air passages in the middle, and two air pipings open on the other end;

(b) a coolant water jacket divided into upstream and downstream coolant water jackets, the upstream and downstream water jacket having an intake coolant water inlet and an exhaust coolant water outlet respectively, the coolant water jacket being defined by means comprising upstream water jacket confinement means, an inner shell having a plurality of openings thereon for the air supply pipings and being welded to said confinement means, an outer shell having a plurality of openings thereon to let the air pipings of the air supply pipings pass through and being welded to said confinement means, the openings on the inner and outer shells being spaced at an angular interval at the same elevation so that each of the air supply pipings can be welded to the outer shell as well as to the inner shell past the opening on the inner shell, a plurality of fan-shaped baffle plates, each of which is placed horizontally in between the inner and outer shells and at the same elevation as the elevation of the baffle strip and is secured there such that the coolant water in the upstream water jacket has its outlet through one water channel of each of the air supply pipings, and an upper ring-shaped flange being welded to the upper ends of the inner and outer shells;

(c) a second junction body placed at the center of the coolant water jacket, each of the air supply pipings being welded to the junction body such that negative radial end of each of the air supply pipings is blocked;

(d) air plenum means for supplying pressurized air into each of the air pipings of the air supply pipings, the plenum means comprising an air plenum encircling the outer shell and at least one air intake piping having a mounting flange on one end, the other end of the air intake piping being welded to the air plenum; and (e) a stationary grate for supporting burning fuel thereon, the stationary grate having concentric rings whose upper surface contour profile repeated for each angular sector confined by the two angularly neighboring air supply pipings is of a periodic fluctuational profile, and being mounted on the air supply pipings, the radially neighboring two concentric rings of the stationary grate being spaced such that the gap between the two neighboring concentric rings of the stationary grate aligns with the air openings on the air piping of the air supply pipings.

41. The apparatus of claim 40, further comprising an air flow rate control valve mounted on the air plenum means.

42. The apparatus of claim 41, wherein a plurality of air piping cleaning openings with a clean-up access blind flange thereon are provided to outer region of the air plenum means such that the accessability into the interior of the air pipings of the air supply piping can be provided through the air piping cleaning opening.

43. The apparatus of claim 42, wherein a burning-agent spray nozzle assembly with at least one burning-agent spray nozzle mounted thereon is provided to the air piping cleaning openings after taking the clean-up access blind flange off the air piping cleaning opening so that burning agent can be admitted into the air piping of the air supply piping through the burning-agent spray nozzle.

44. The apparatus of claim 43, wherein the burning-agent spray nozzle is mounted such that the nozzle tip of the burning-agent spray nozzle aligns with each axis of the two air pipings of the air supply piping.

45. The apparatus of claim 43, wherein burning-agent spray is made such that the burning-agent spray into at least one air piping of each of the air supply pipings is made in cyclic fashion.

* * * * *